US007523921B2

(12) United States Patent
Garrity

(10) Patent No.: US 7,523,921 B2
(45) Date of Patent: Apr. 28, 2009

(54) HIGH WIND FENCE SYSTEM

(76) Inventor: Robert M. Garrity, 425 San Mateo Dr., Palm Springs, FL (US) 33461-1521

( * ) Notice: Subject to any disclaimer, the term of this patent is extended or adjusted under 35 U.S.C. 154(b) by 225 days.

(21) Appl. No.: 11/624,919

(22) Filed: Jan. 19, 2007

(65) Prior Publication Data

US 2008/0173855 A1 Jul. 24, 2008

(51) Int. Cl.
*E04H 17/14* (2006.01)

(52) U.S. Cl. ..... 256/67; 256/26; 256/DIG. 2

(58) Field of Classification Search ..... 256/1, 256/26, 67, DIG. 2
See application file for complete search history.

(56) References Cited

U.S. PATENT DOCUMENTS 284,528 A * 9/1883 Withrow ..... 256/DIG. 2
5,156,432 A * 10/1992 McCleary ..... 296/61
5,364,076 A * 11/1994 Nicholls ..... 256/26
5,372,354 A * 12/1994 Cacicedo ..... 256/24
6,213,053 B1 * 4/2001 Lammers ..... 119/51.01
7,461,489 B2 * 12/2008 Herbertsson ..... 256/24

* cited by examiner

*Primary Examiner*—Victor MacArthur
(74) *Attorney, Agent, or Firm*—McHale & Slavin, P.A.

(57) ABSTRACT

The present invention provides a fence system for homes, buildings and the like. The fence system according to the instant invention includes panels constructed and arranged to be pivoted between a vertical orientation and a horizontal orientation. When connected to permanently mounted posts in a vertical orientation, the fence panels may be utilized for privacy and/or security. Pivoting the panels to horizontal position during storms, such as hurricanes, reduces or eliminates the damage caused to the fence by high winds and/or wind-borne debris.

8 Claims, 8 Drawing Sheets

HIGH WIND FENCE SYSTEM

FIELD OF THE INVENTION

This invention relates generally to fencing. More specifically, to a fencing system that includes fence panels constructed and arranged to be pivoted to a horizontal position to prevent fencing damage from high winds and flying debris.

PRIOR ART BACKGROUND

The United States has experienced over 60 weather-related disasters in the past 25 years, each of which has caused in excess of $1 billion in damages. Together, these disasters have caused in excess of $350 billion in damage.

Population growth along the coastline of the United States has resulted in an increased risk to life and property from hurricane related damage. There are approximately 153 million residents that live in coastal counties of the United States, with areas such as Texas, Florida, and the Carolinas, where hurricanes frequently strike, experiencing rapid population growth. In addition, many coastal areas experience substantial but temporary population increases from holiday, weekend, and vacation visitors during hurricane season.

Homes, buildings, fences and other permanent structures often suffer substantial damage when windborne debris and storm generated winds overload the capacity of the structure.

Fences are often erected in congested areas to provide privacy and safety to the homeowner. In fact, many coastal areas have laws requiring fences to be built around swimming pools or yards that contain swimming pools to reduce pool related accidents. These fences are often constructed of wood, plastic, aluminum, steel or other structural material at great expense to the homeowner. The fences generally include a plurality of vertically oriented posts anchored within the ground and fence panels permanently affixed to and extending between the vertical posts. Due to the permanent and structural nature of fences, they are often damaged or destroyed by the strong winds generated in coastal storms.

Removal and storage of the fence panels before a storm is generally impractical. Most fences are not constructed to allow for disassembly without destroying the fence panels. Even if the panels could be removed, storage of the panels would be difficult and would consume a significant portion of the available storage space. In addition, the inherent weight of the fence panels would require a support structure to prevent the panels from tipping or falling while stored. Still yet, due to the congested population of coastal areas, many families live in condominiums or apartments. Most of these dwellings do not have a garage or other space which could be dedicated to fence panel storage.

Prior art fencing examples include, Itri et al., U.S. Pat. No. 4,465,262, discloses a portable expandable barrier which comprises a pair of fences slideably interconnected and releasably held in a desired orientation by locking means such as lock set cylinders. Nicholls, U.S. Pat. No. 5,364,076, discloses a fence structure including a barrier and elongated fence posts. The fence posts include T-shaped slots in which end portions of the fence sections are received prior to final assembly of the posts. In general these fences are constructed as permanent structures. Thus, removal of the panels to minimize storm related damage to the fence would require complete disassembly of the fence structure.

Therefore, what is needed in the art is a fence system that allows the fence panels to be pivoted to a substantially horizontal position during a storm which produces high winds. The fence system should provide brackets that are constructed for easy installation on pre-existing as well as new fencing. The construction of the upper retainer brackets should allow detachment of the upper portion of the fence panels from the posts while the lower brackets should be hinged so that the fence panels can be pivoted for securement to the ground in a substantially horizontal orientation. Stakes should be provided to secure the fence panels to a ground surface in their horizontal orientation. After the storm, the panels should be re-engagable to the posts in the vertical orientation to provide privacy and security.

SUMMARY OF THE PRESENT INVENTION

The present invention provides a fence system for homes, buildings and the like. The fence system according to the instant invention includes panels constructed and arranged to be pivoted between a vertical orientation and a horizontal orientation. When connected to permanently mounted posts in a vertical orientation, the fence panels may be utilized for privacy and/or security. Pivoting the panels to horizontal position during storms, such as hurricanes, reduces or eliminates the damage caused to the fence by high winds and/or wind-borne debris. The panels include hinged brackets mounted on the lower portions thereof which allow the panels to be pivoted between the two positions. Removable retainer brackets are secured to the mid and upper portions of the panels and the fence posts to maintain the panels in a vertical orientation. Removal of the retainer brackets permits pivoting the panels between the two positions. Hold-down assemblies are provided which cooperate with the ground surface and the panels to hold the panels in the horizontal position for storms. The hold-down assemblies prevent the panels from lifting during high wind situations. This construction permits the panels to be secured either in a vertical position with respect to the posts or in a horizontal position for protecting the fence from high winds and/or wind-borne debris.

Therefore, it is an objective of this invention to provide a high wind fence system.

It is another objective of the instant invention to provide a fence system capable of providing privacy as well as reduce or eliminate damage caused to the fence from high winds.

It is a further objective of the instant invention to provide a fence system which includes panels adapted to pivot for protection against high winds and wind-borne debris.

It is yet another objective of the instant invention to provide a fence having panels that are constructed and arranged for pivotal movement between a vertical position for privacy and a horizontal position for protection against high winds and wind-borne debris.

A still further objective of the instant invention is to provide a hinged bracket assembly and a retainer bracket member that can be used to convert a pre-existing fence into a hurricane fence.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION OF THE INVENTION

Figure 1:
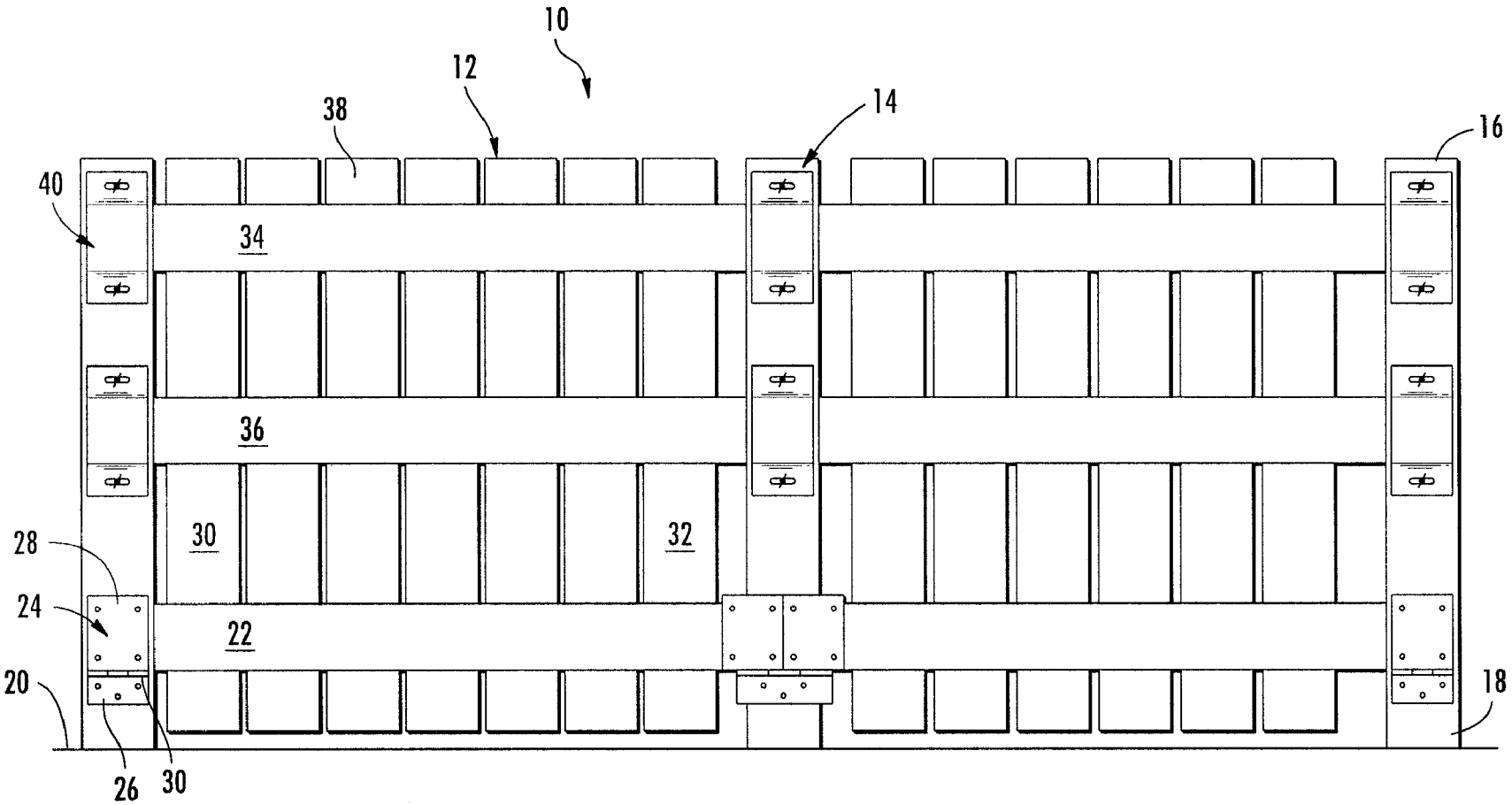
FIG. 1 is a front view, illustrating one embodiment of the instant invention wherein the fence panels are illustrated in a vertical orientation.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
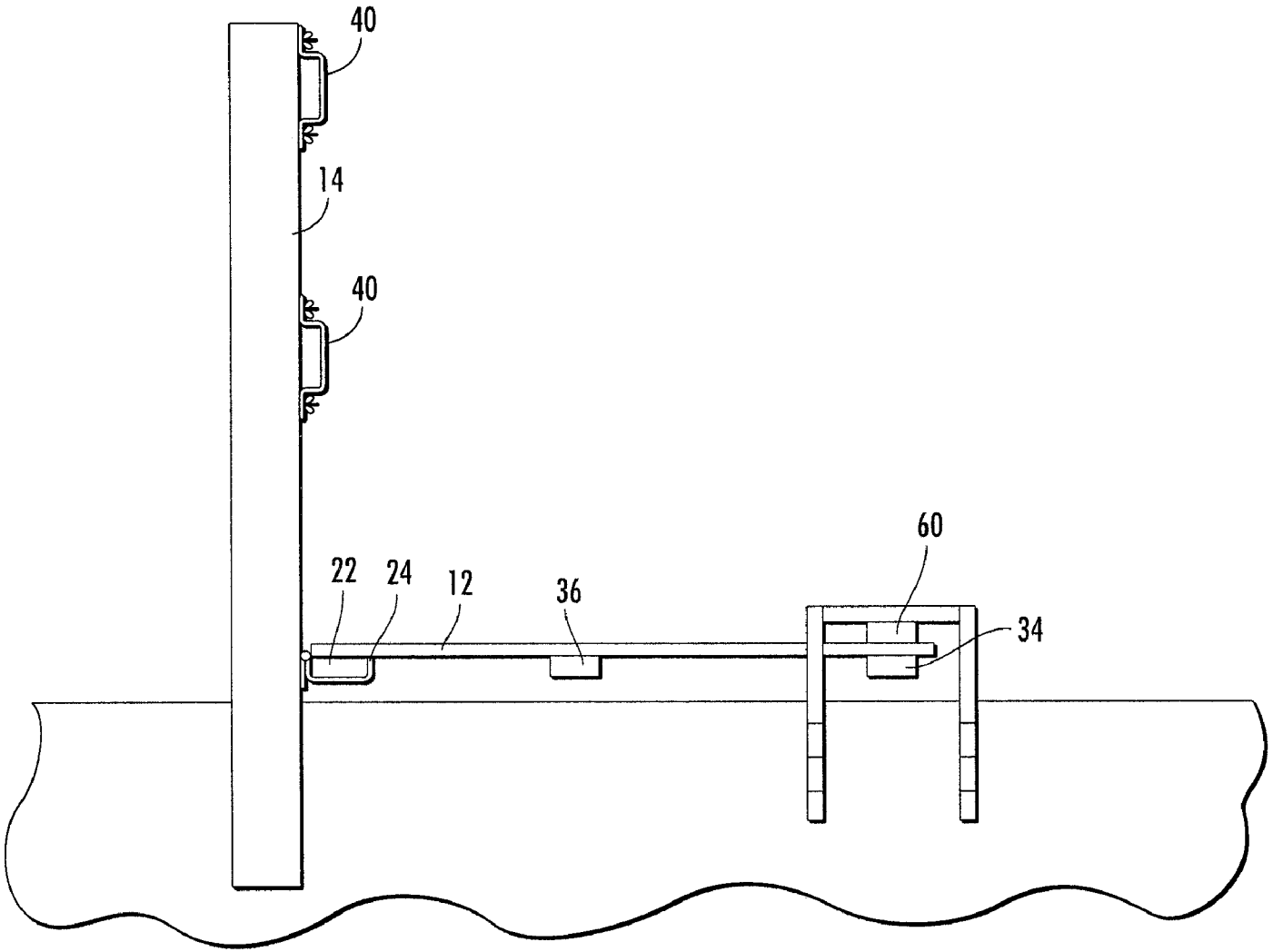
FIG. 2 is a side view illustrating one embodiment of the instant invention wherein the fence panels are illustrated in a horizontal orientation.

Referring to the FIGS. 1 and 2, a hurricane fence system 10 is illustrated. The hurricane fence system includes permanently mounted posts 14 and at least one panel 12 that is constructed and arranged to be pivoted between a vertical orientation for privacy and a horizontal orientation for storm protection. FIG. 1 illustrates a preferred embodiment of the fence system 10. The fence includes at least two spaced apart substantially vertical posts 14. The posts having an upper portion 16 and a lower portion 18, the lower portion is constructed and arranged to be secured to or within a ground surface 20. The lower portion of the posts may be secured to the ground surface by any method well known in the art which may include, but should not be limited to, burying a portion of the post, setting a portion of the post in concrete, using fasteners or brackets to secure the post to a hard surface, weldment or any suitable combination thereof.

The panel 12 includes a lower stringer 22, an upper stringer 34 and a middle stringer 36, each having sufficient length to extend between a first end 30 and a second end 32 of the panel. A plurality of substantially vertical members 38 are secured to the stringers to provide privacy and/or security. In the preferred embodiment, the stringers and the vertical members are constructed of wood. However, it should be noted that the stringers and/or the vertical members may be constructed of any material suitable for use as fencing, such materials may include, but should not be limited to metal, plastic, concrete and suitable combinations thereof.

Figure 3:
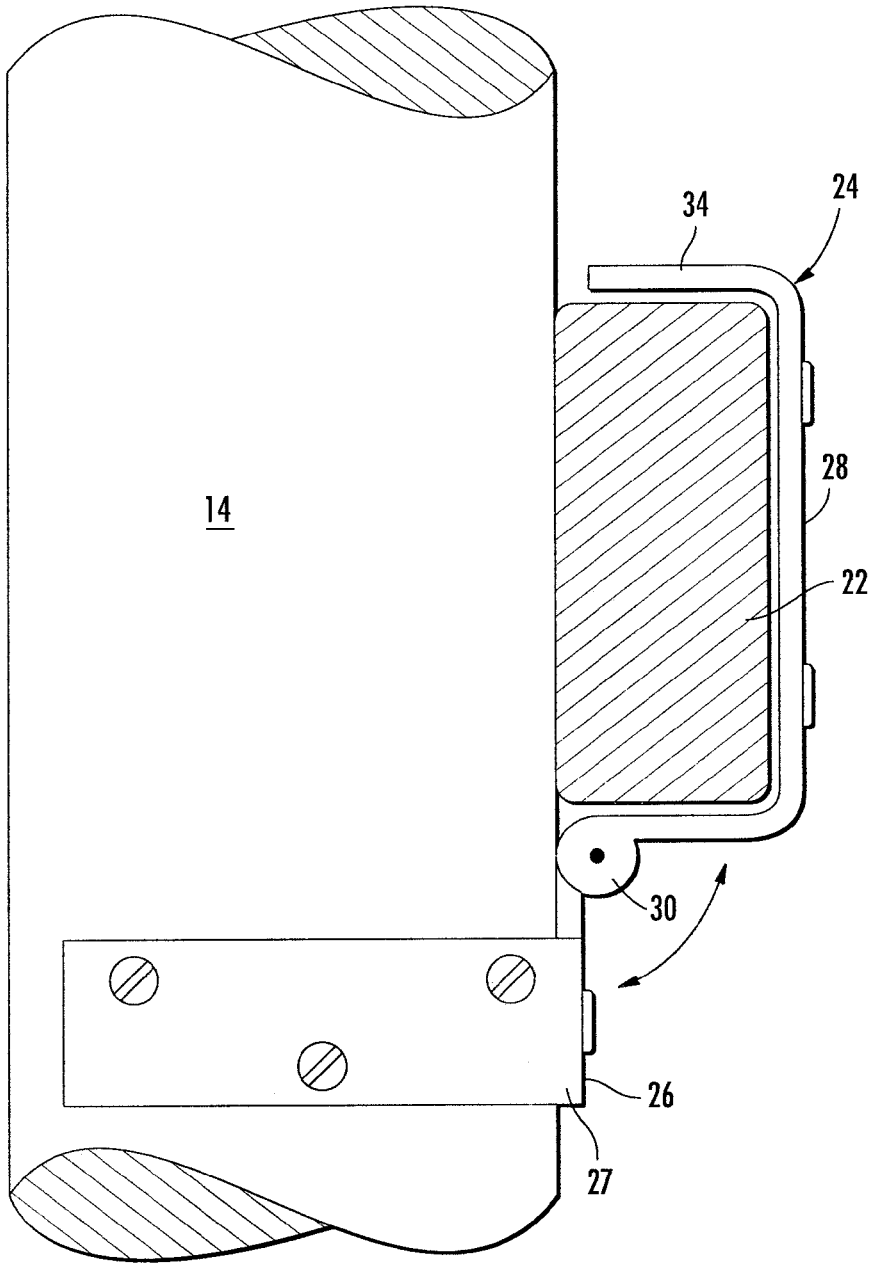
FIG. 3 is a partial side view illustrating a lower hinged bracket assembly which may be utilized to pivot the fence panels between a vertical and a horizontal position.
Figure 4:
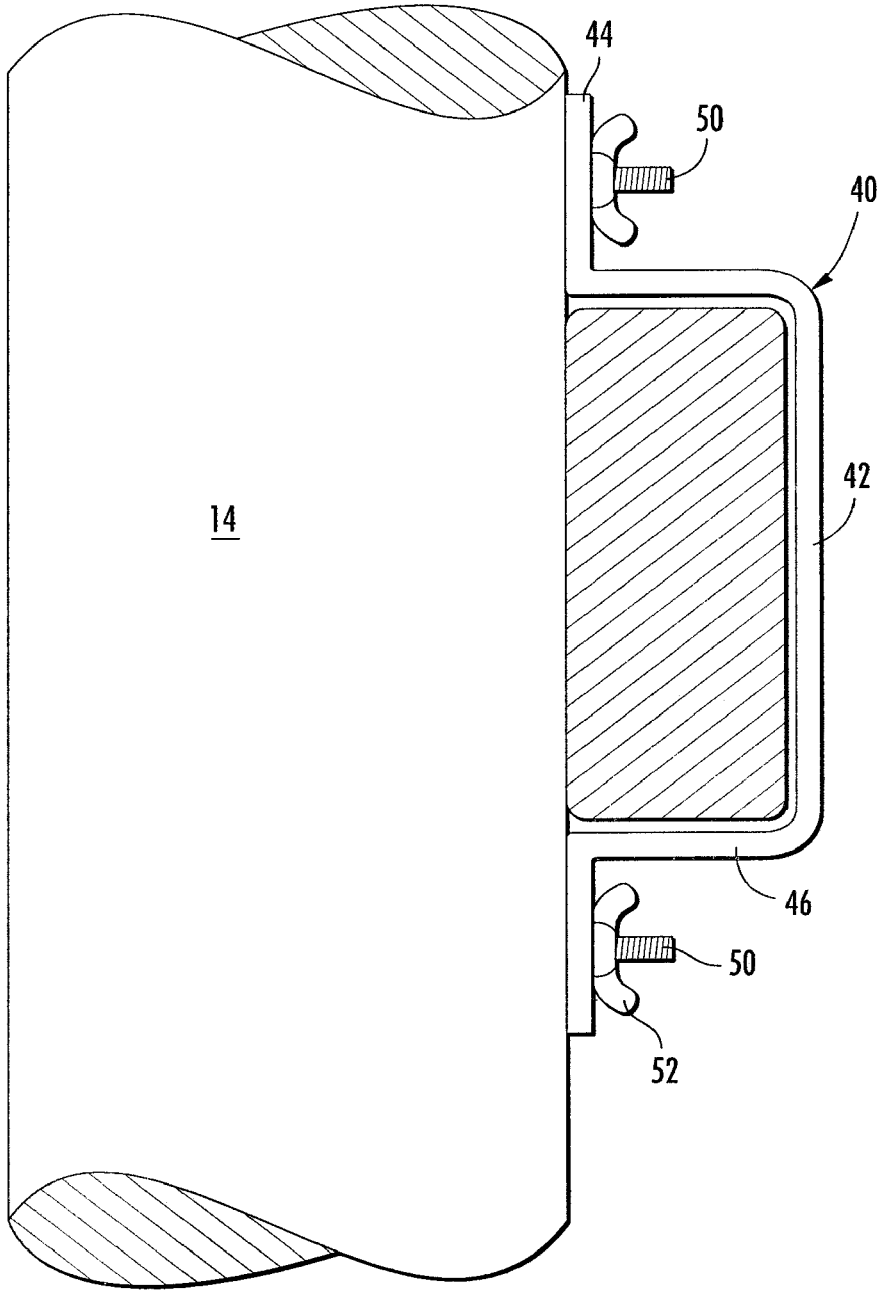
FIG. 4 is a partial side view illustrating a retainer bracket which may be utilized to secure a fence panel to a post in a vertical orientation.
Figure 5:
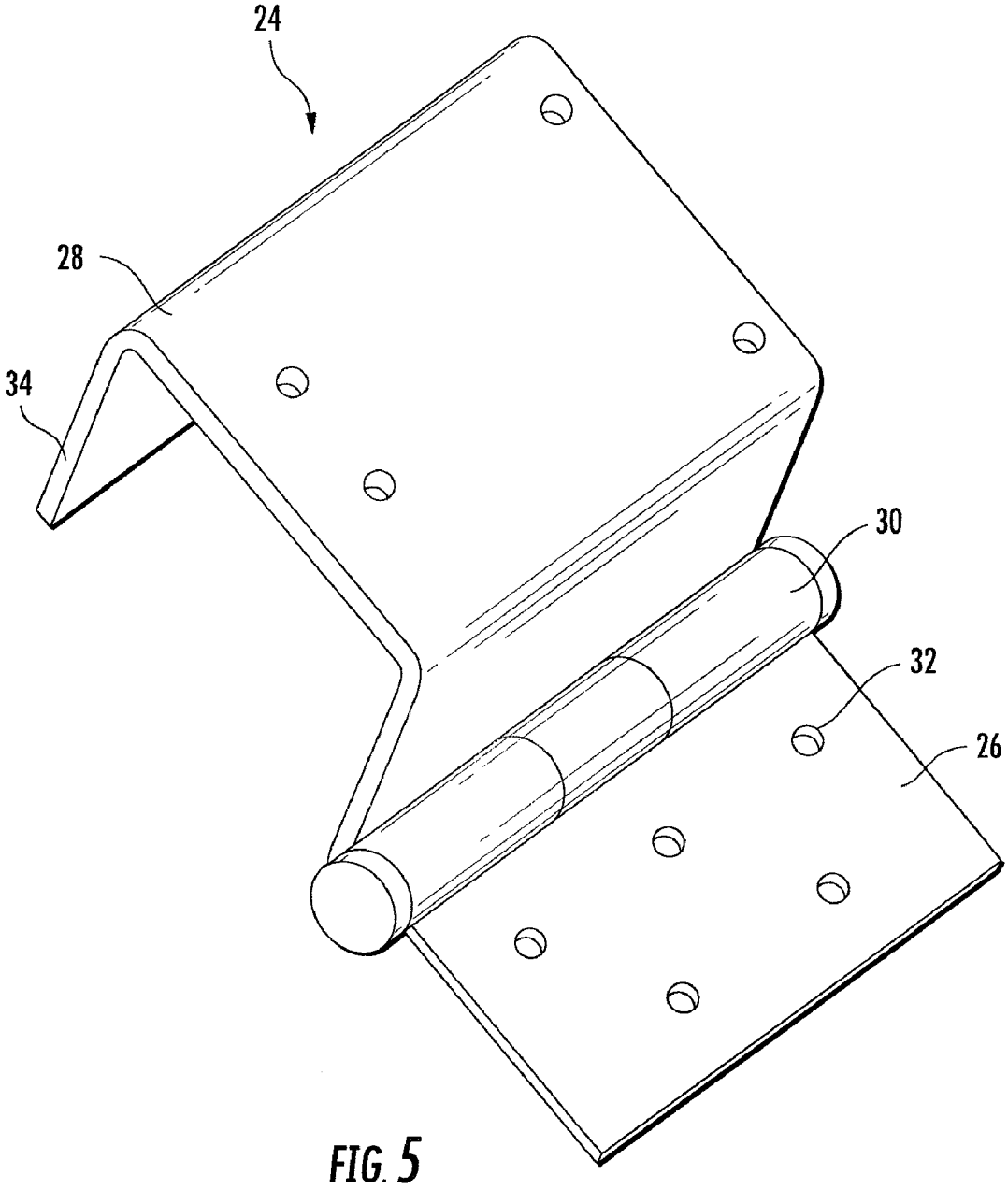
FIG. 5 is a perspective view illustrating one embodiment of a hinged bracket assembly.
Figure 6:
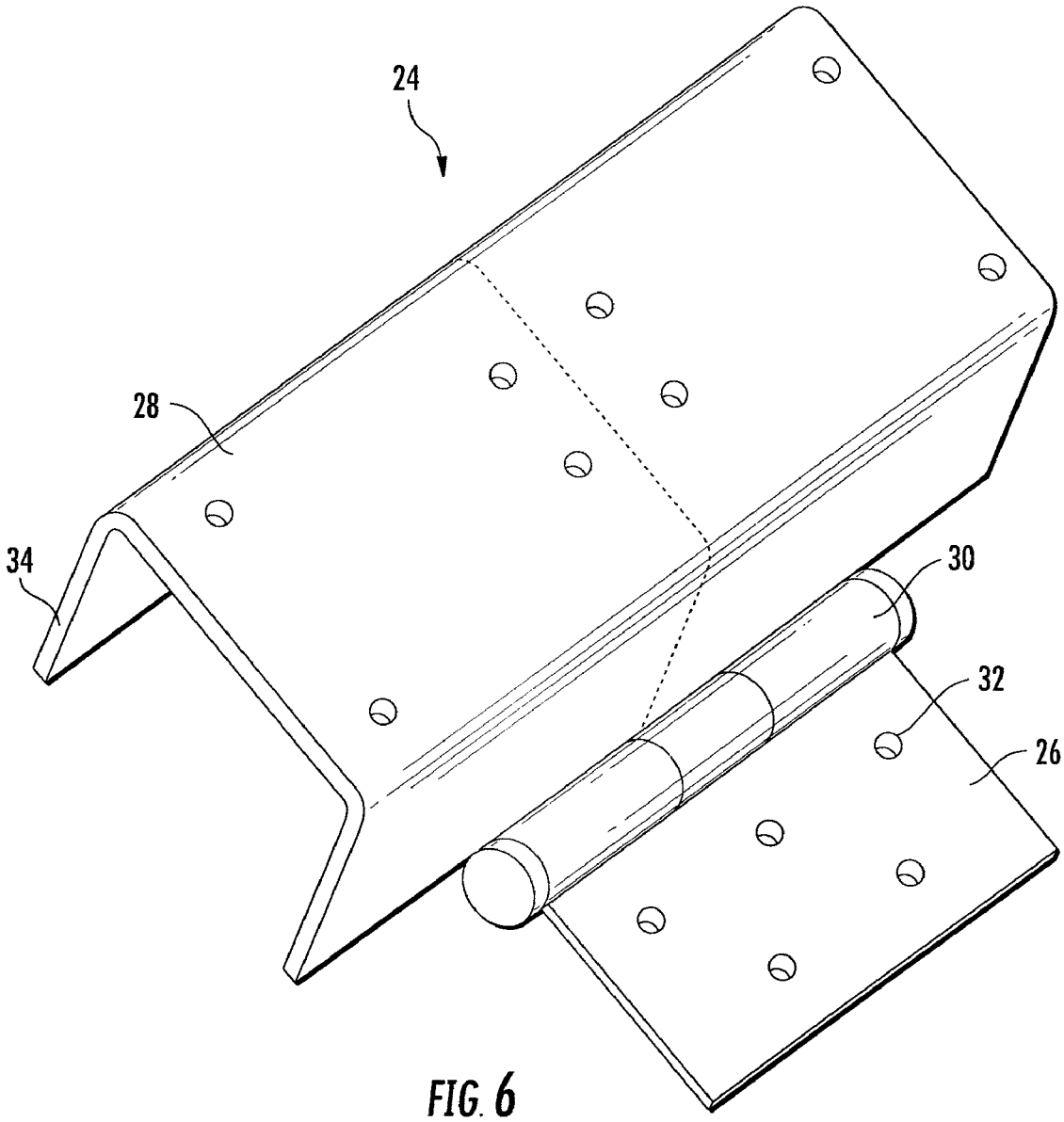
FIG. 6 is a perspective view illustrating a hinged bracket assembly for securement to two stringers.
Figure 7:
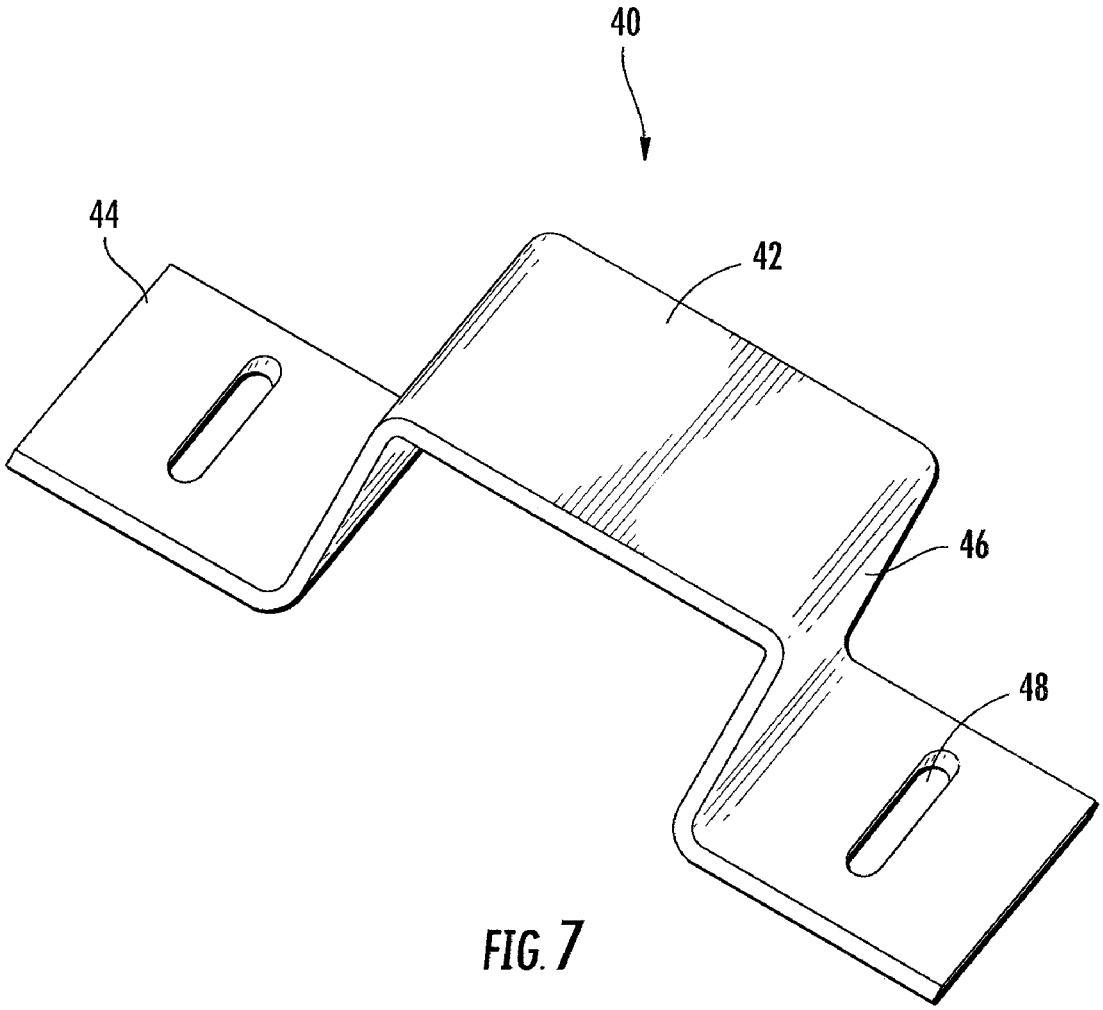
FIG. 7 is a perspective view of a retainer bracket of the instant invention.

Referring to FIGS. 1-3 and 5-6, secured to the lower portion of each post are hinged bracket assemblies 24. The hinged bracket assemblies are generally constructed and arranged to cooperate with a post 14 and a lower stringer member 22. The hinged bracket assembly includes a base 26, a body 28, and a hinge 30. The base 26 includes a plurality of apertures 32 sized to accept fasteners for securing the base to a post 14. The body is generally U-shaped to include two legs 34, the legs are spaced and sized to extend substantially around the sides of the lowermost panel stringer 22. The body 28 is suitable secured to the hinge to be pivotable about the hinge 30 for movement between a vertical position and a horizontal position. The hinged bracket assemblies 24 may be secured to the posts and the stringers by any suitable means well known in the art, which may include but should not be limited to, fasteners, adhesive, weldment, cast in place or any suitable combination thereof. FIG. 6 illustrates one embodiment of the hinged bracket wherein the body 28 is formed wide enough to cooperate with stringers of two adjacently positioned panels. FIG. 3 illustrates an alternative embodiment of the hinged bracket wherein the base includes an integral side support 27. The side support provides additional weight capacity and resistance to high winds.

Referring to FIGS. 1-2, 4 and 7, the retainer members 40 are generally constructed and arranged to cooperate with the stringer members and the posts to selectively retain the fence panel 12 in a vertical orientation. The retainer members include a generally U-shaped body 42 with two tabs 44 extending perpendicularly from the ends of the upstanding legs 46. In this manner the retainer body can substantially enclose the stringer to cause a reliable securement of the panel. The tabs include elongated apertures 48 sized for cooperation with studs 50. Wing nuts 52 are sized to cooperate with the studs 50 for removable interlocking engagement. It should be noted that fasteners other than the stud and wing nut combination can be utilized without departing from the scope of the invention. Such fasteners may include, but should not be limited to, bolts, screws, bayonet type fasteners, magnets and suitable combinations thereof.

Figure 8:
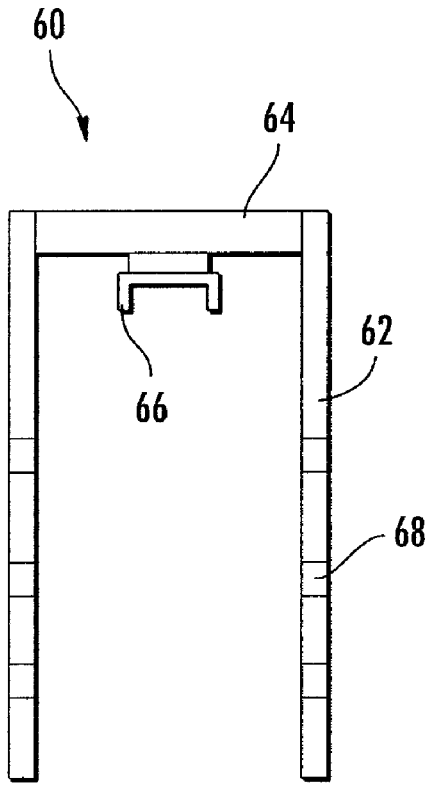
FIG. 8 is a side view of a hold-down member of the instant invention.
Figure 9:
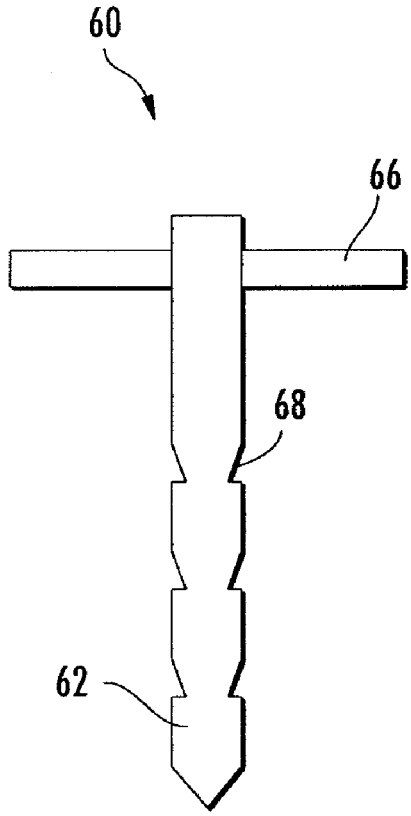
FIG. 9 is a front view of the hold-down member of FIG. 8.

Referring to FIGS. 8 and 9, the hold-down assembly 60 is illustrated. The hold-down assembly is generally constructed and arranged to cooperate with at least one and preferably two panels 12 oriented horizontally to substantially prevent the panels from lifting during high winds. The hold-down assembly includes at least one stake member 62, a connector member 64 and a lateral member 66. The stake member(s) 62 include notches or barbs 68 which cooperate with the ground 20 to prevent unwanted lifting of the hold-down assembly during use. The connector member is utilized to connect the upper portions of any number of stake members together so that they may be inserted or withdrawn from the ground as a single unit. The lateral member 66 is connected to the connector member or directly to the stake member to extend outwardly therefrom in at least one direction for engaging the panel assemblies 12. In the preferred embodiment, the hold-down assembly is constructed from metal however, it should be noted that other materials suitable for securing a panel to a ground surface may be used without departing from the scope of the invention such materials may include, but should not be limited to, plastic, wood or suitable combination thereof.

Referring to the FIG. 2, the panel is tilted to the horizontal orientation by removing the wing nuts 52 from the studs 50. Thereafter, the retainer brackets are removed allowing the panel 12 to be rotated into a horizontal orientation. A hold-down assembly 60 may then be driven into the ground surface 20 between the distal ends of adjacent panels until the lateral member 66 contacts the panels to hold the panels in the horizontal orientation. The retainer members may be placed over the studs and the wing nuts utilized to store the retainer members on the posts. Moving the panels back to a vertical orientation requires the hold-down assembly to be pulled from the ground. The panels are moved manually back to the vertical position, whereby the stringers contact the posts. The retainer members are then placed around the stringers and over the studs. The wing nuts can then be replaced onto the studs and tightened to retain the panel in the vertical orientation.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A high wind fence system comprising:

a first and a second post secured in a substantially parallel and vertical arrangement, said first and said second posts each having an upper portion and a lower portion, said lower portion constructed and arranged to be secured to a ground surface;

a panel having a first end, a second end, an upper portion and a lower portion, an upper stringer extending between said first and second ends of said upper portion, a lower stringer extending between said first and said second ends of said lower portion;

a first hinged bracket assembly secured to a first end of said lower stringer and said lower portion of said first post for pivotable movement therebetween, a second hinged bracket assembly secured to a second end of said lower stringer and said lower portion of said second post for pivotable movement therebetween, whereby said first and said second hinged bracket assemblies are adapted to allow said panel to be moved between a vertical orientation and a horizontal orientation with respect to said ground surface;

a first and a second retainer member, said first retainer member constructed and arranged to selectively secure a first end of said upper stringer to said upper portion of said first post, whereby said panel is secured in a vertical orientation, said second retainer member constructed and arranged to selectively secure a second end of said upper stringer to said upper portion of said second post, whereby said panel is secured in a vertical orientation; a hold-down assembly including at least one stake member, an upper portion of said at least one stake member including a lateral member secured thereto, said lateral member extending outwardly and oriented transversely with respect to said stake member for cooperation with at least one said panel, whereby said stake member is adapted to be driven into said ground surface until said lateral member cooperates with said panel to maintain said panel in said horizontal orientation for protection of said fence against high winds.

2. The high wind fence system of claim 1 wherein said at least one stake member includes two stake members secured together at an upper portion of the hold-down assembly with a connector member, said lateral member secured to said connector member, whereby said stake members are constructed and arranged to be driven into and removed from the ground together.

3. The high wind fence system of claim 1 wherein each of said hinged bracket assemblies include a base portion, a body portion, and a hinge portion, said base portion including a plurality of apertures sized to accept fasteners for securing said hinged bracket to said lower portion of said first or said second post, said body portion being constructed and arranged for securement to said first or said second end of said lower stringer, said hinge portion connecting said base portion and said body portion, whereby said body portion is pivotable about said hinge portion between said vertical orientation and said horizontal orientation.

4. The high wind fence system of claim 3 wherein said body portion is substantially U-shaped to include two legs, said legs being spaced and sized to extend substantially around three sides of said lowermost panel stringer.

5. The high wind fence system of claim 1 wherein said retainer members include a generally U-shaped body with two tabs extending outwardly from ends of upstanding legs, said tabs including apertures sized for cooperation with at least one fastener for securing said retainer members to said posts.

6. The high wind fence system of claim 5 wherein said at least one fastener is a pair of stud members for each said retainer member, said stud members each having a first end and a second end, said first end in engagement with said upper portion of said post, said second end extending outwardly with respect to said post, a nut member threadably engaged to each said second end of each said stud member for removable interlocking engagement therebetween.

7. The high wind fence system of claim 5 wherein said fence panel includes a middle stringer, said middle stringer extending between said first end and said second end of said panel, a third and a fourth retainer member, said third retainer member constructed and arranged to selectively secure a first end of said middle stringer to a middle portion of said first post, whereby said panel is secured in a vertical orientation, said fourth retainer member constructed and arranged to selectively secure said second end of said middle stringer to a middle portion of said second post, whereby said panel is secured in a vertical orientation.

8. The high wind fence system of claim 1 wherein said panel is substantially imperforate.

* * * * *